United States Patent [19]

Fujita

[11] Patent Number: 4,989,528

[45] Date of Patent: Feb. 5, 1991

[54] SEWING MACHINE NEEDLE MOUNTING DEVICE

[75] Inventor: Shuji Fujita, Chofu, Japan

[73] Assignee: Juki Corporation, Chofu, Japan

[21] Appl. No.: 485,622

[22] Filed: Feb. 27, 1990

[30] Foreign Application Priority Data

Feb. 28, 1989 [JP] Japan ..... 1-23267[U]

[51] Int. Cl.[5] ..... D05B 55/04

[52] U.S. Cl. ..... 112/226

[58] Field of Search ..... 112/223–226

*Primary Examiner*—Werner H. Schroeder

*Assistant Examiner*—Sullivan C. Prak

*Attorney, Agent, or Firm*—Morgan & Finnegan

[57] ABSTRACT

A sewing machine needle mounting device includes a grip portion and a needle engaging portion. A vertical hole is vertically passed through the engaging portion. The hole may be configured in two shapes. One preferred configuration is an inversed cone which includes a substantially vertically extending ledge to fit within a thread guide of a sewing machine needle. Another preferred configuration is an inversed hemicone to engage with a flat surface of the sewing machine needle. The invention is useful for mounting needles to needle bars of both domestic and industrial sewing machines.

2 Claims, 5 Drawing Sheets

(a)

(b)

SEWING MACHINE NEEDLE MOUNTING DEVICE

FIELD OF THE INVENTION

The invention relates to a sewing machine needle mounting device for mounting a needle on a sewing machine needle bar.

BACKGROUND OF THE INVENTION

Heretofore, in known practices, it has been customary in overlock sewing machines and the like to mount a needle in a needle bar when the needle bar is raised to a position near the "top dead center." However, in such cases, both the upper knife and the looper are projected upwardly with respect to the throat plate and are thus located adjacent the needle, causing interference with the bar. Thus, much difficulty has been encountered in mounting the needle to the needle bar. Moreover, when a two needle overlocking sewing machine is used, it is even more troublesome to mount the needle to the needle bar.

In order to avoid these problems, a device has previously been proposed for use in mounting the needle. FIGS. 3 to 5 illustrate such a conventional needle mounting device which was intended to avoid the earlier manual needle mounting operations, which relied on an operator's fingers to mount the needles.

In the drawings of FIGS. 3–5, numeral 1 denotes a needle mounting device which includes a needle holder 2 for holding a sewing machine needle 4. The needle 4 is formed at its front face with a thread guide 4*c* axially extending along the needle. A nipper 3 is provided including a branch 3*c* formed into fork end 3*a*, 3*b* between which the needle holder 2 is releasably mounted.

As shown in FIG. 5, the needle holder 2, which is formed of flexible materials such as rubber, synthetic resin, cork or the like, is shaped into a plate form of substantially oval cross section. The needle holder 2 is provided, at its opposite sides, with a flat surface 2*a* and a deformed arcuated surface 2*b* so as to primarily determine the mounting orientation of the needle holder 2 with respect to the nipper 3. This configuration is intended to prevent the needle holder 2 from being mounted in an improper orientation.

As shown in FIGS. 4 and 5, the needle holder 2 is formed with a directional line 5. A guide line 6 intersects the directional line 5 at a right angle on the upper surface of the needle holder. At the intersecting point of the two lines 5, 6, a hole 7 is bored through the needle holder 2 in the direction of the plate thickness. The hole 7 is adapted to releasably receive (by pressure) and to hold the needle 4 after aligning the thread guide 4*c* with the directional line 5.

FIG. 3 also illustrates a needle bar 8 with a needle accommodating channel 9 and a needle set screw 10 for locking the needle 4 after it is inserted in the needle accommodating channel 9.

For mounting the needle in the needle bar 8, the needle 4 is initially forced from above into the through hole 7 of the holder 2 with the thread guide 4*c* aligned with the directional line 5. The needle 4 is thus held in position within the holder 2. Then, the butt or tail end of the nipper 3 is clamped to tightly hold the needle 4 through the holder 2 The needle holder 2, supported by the nipper 3, is moved so as to have access to the needle bar 8. The needle shank is urged against and into the inside of the needle accommodating channel 9 of the needle bar 8 for locating the needle 4 in its correct position and may be rotated about its axis inside the needle accommodating channel 9 for position alignment.

The set screw 10 is then secured to lock the needle 4 in its correct position. The mounting device 1 is then downwardly moved to draw the needle 4 out of the hole 7.

Although useful, the aforementioned conventional needle mounting device has several disadvantages.

First, in the conventional device, it is necessary to have the thread guide aligned with the directional line 5 and then to force the needle into the through hole in the needle holder 2 for mounting the needle thereto. This requires a complicated operation. Further, the operator may inadvertently force the needle into the through hole in misalignment therewith, resulting in damage to the thread guide and in difficulty in drawing the needle out of the through hole.

Furthermore, once the needle has been forced into the through hole, it may be difficult to remove the needle mounting device from the needle after mounting the needle to the needle bar. The needle may be thereby damaged unless careful attention is paid when the needle is drawn out.

Further still, if poor engagement is made between the needle and the through hole 7, the needle may be readily drawn out of the needle holder, contrary to what is intended in operation of the device, and this may result in deterioration of the workability of the device.

It is therefore an object of the invention to provide a needle mounting device for securably holding the needle, for readily mounting the needle to a needle bar and for readily disengaging the needle from the needle bar.

It is another object of the invention to provide a needle mounting device for firmly mounting the needle to the needle bar in the correct position.

It is a further object of the invention to provide a needle mounting device for receiving the needle without involving misalignment and damage to the needle.

It is another object of the invention to provide a needle mounting device which is capable of quickly, readily, and properly mounting the needle to the needle bar without requiring additional tools, thus saving labor and time.

It is a further object of the invention to provide a needle mounting device which is capable of facilitating the mounting of the needle to the needle bar through proper orientation and positional alignment of the needle with respect to the bar.

It is still further object of the invention to provide a needle mounting device which is capable of readily determining the needle orientation with respect to the device and the needle bar.

It is still further object of the invention to provide a needle mounting device for use with both industrial sewing machines and household sewing machines.

SUMMARY OF THE INVENTION

These and other objects of the invention are met by providing a sewing machine needle mounting device which includes a needle engaging portion and a grip portion. The engaging portion is provided with a hole vertically passed therethrough. In one embodiment, the hole is partially formed as an inverted cone, and a ledge is formed on the conical portion to fit in a thread guide.

In another embodiment, the hole is partially formed as an inversed hemicone to mate with the flat surface of a needle. The invention may be thereby applied for use with either commercial or home sewing machines.

BRIEF DESCRIPTION OF THE DRAWINGS

The invention will be described in greater detail below by way of reference to the following drawings, in which.

DESCRIPTION OF THE PREFERRED EMBODIMENTS

Figure 1:
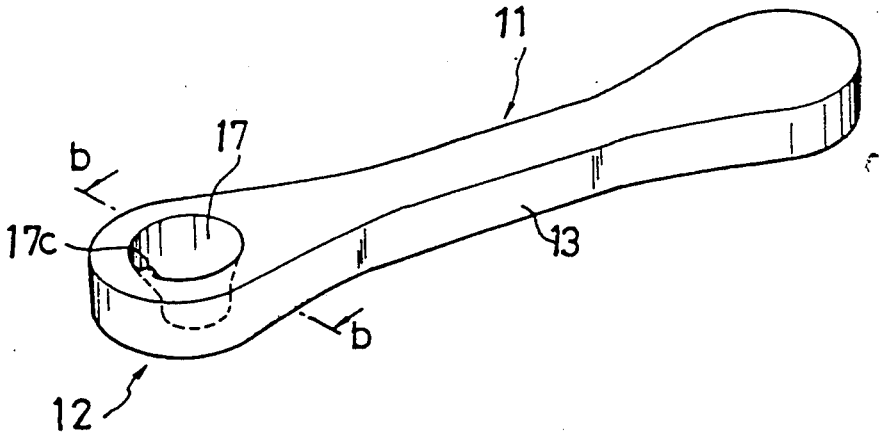
FIG. 1*a* is a perspective view of a sewing machine needle mounting device according to one embodiment of the invention.
FIG. 1*b* is a sectional view taken along the line b—b of FIG. 1*a;*
FIG. 1*c* is a partially broken plan view of the needle engaging portion of the device shown in FIG. 1*a;*
Figure 1:
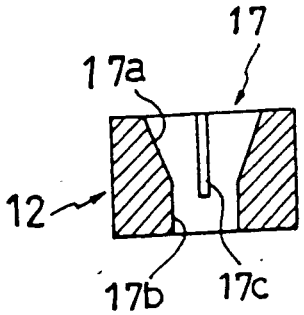
Figure 1:
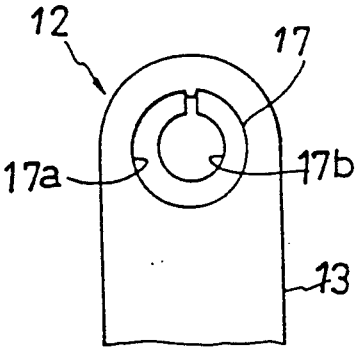

Referring now to the drawings, FIGS. 1*a*–1*c* and FIG. 2 show a sewing machine needle mounting device according to one embodiment of the invention. Numeral 11 designates a sewing machine needle mounting device which includes a grip portion 13 and a needle engaging portion 12 provided at one end thereof. The mounting device 11 may be formed of suitable materials such as metal, synthetic resin or the like.

Numeral 17 indicates a through hole provided through the needle engaging portion. The hole 17 is partially formed of an inverted cone portion 17*a* and a cylindrical portion 17*b*. A ledge 17*c* is formed substantially vertically on the conical portion 17*a* and is protruding from the surface of said portion.

Figure 2:
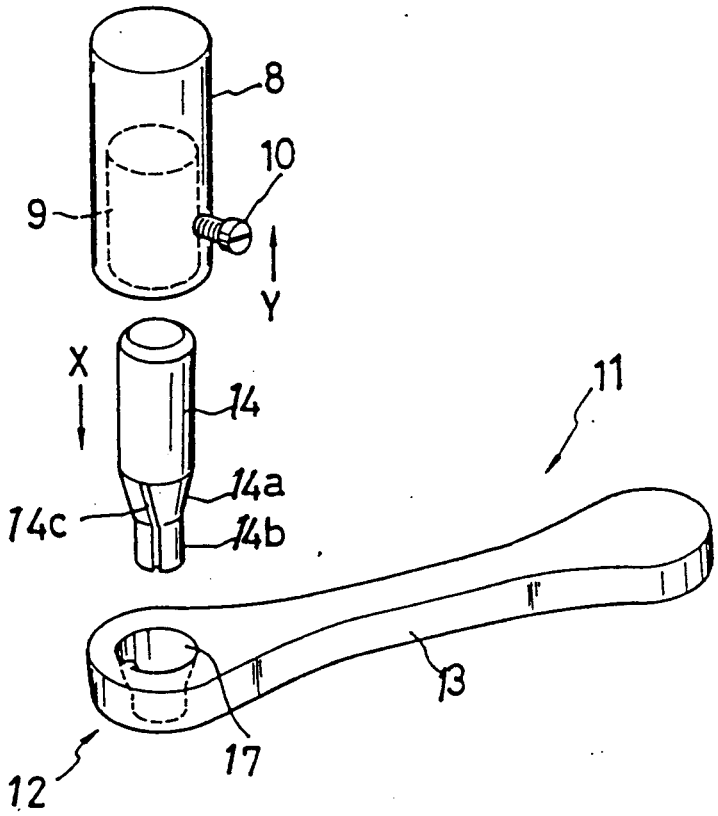
FIG. 2 is a perspective exploded view of a needle bar, a needle, and the needle mounting device of FIG. 1*a*, showing the manner in which the needle is mounted to the needle bar by use of a needle mounting device according to the invention.
Figure 3:
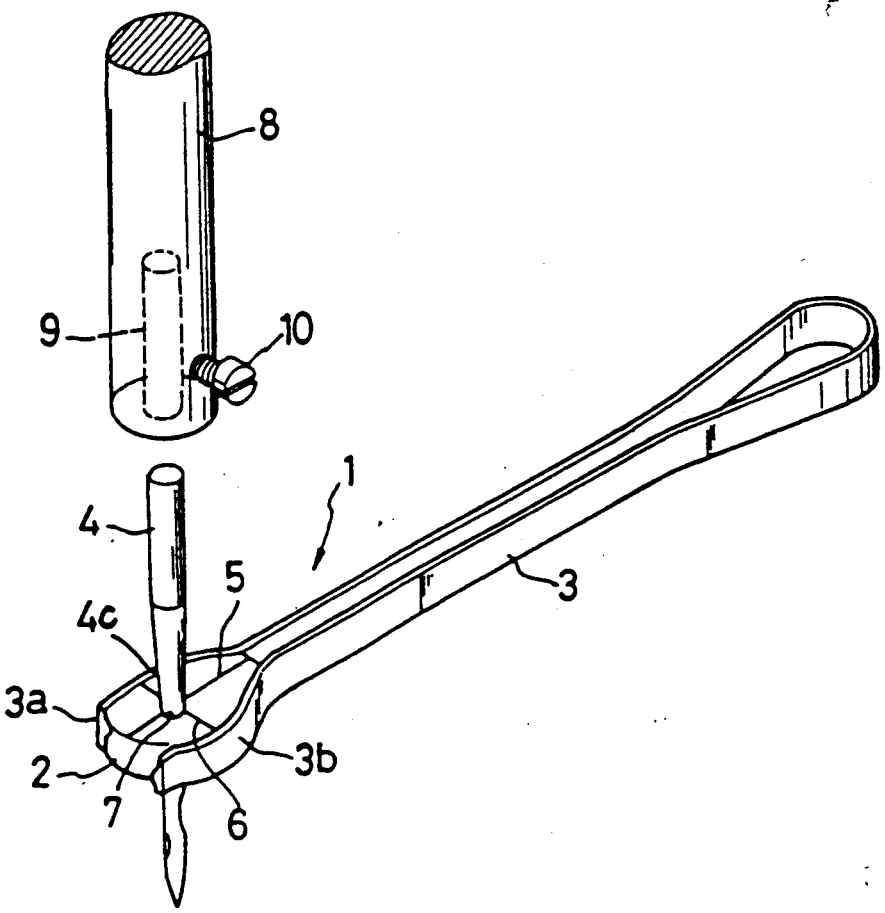
FIG. 3 (PRIOR ART)
FIGS. 3 to 5 are perspective views showing the manner in which a needle is mounted to a needle bar by use of a conventional mounting device according to the prior art.
Figure 4:
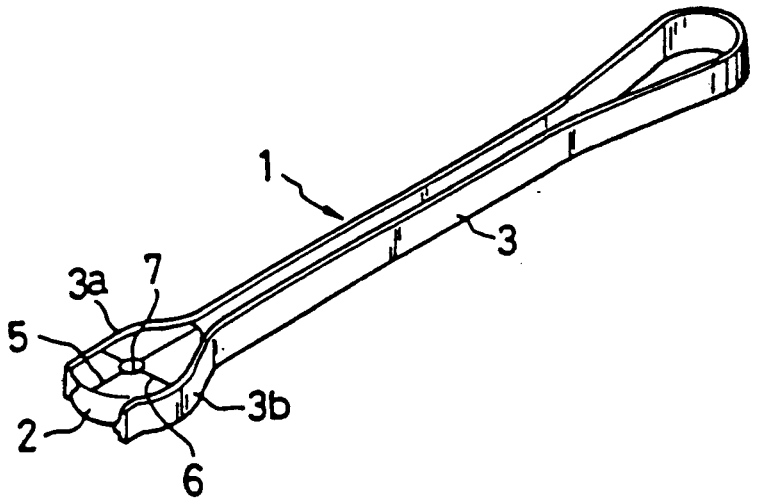
FIG. 4 (PRIOR ART)
Figure 5:
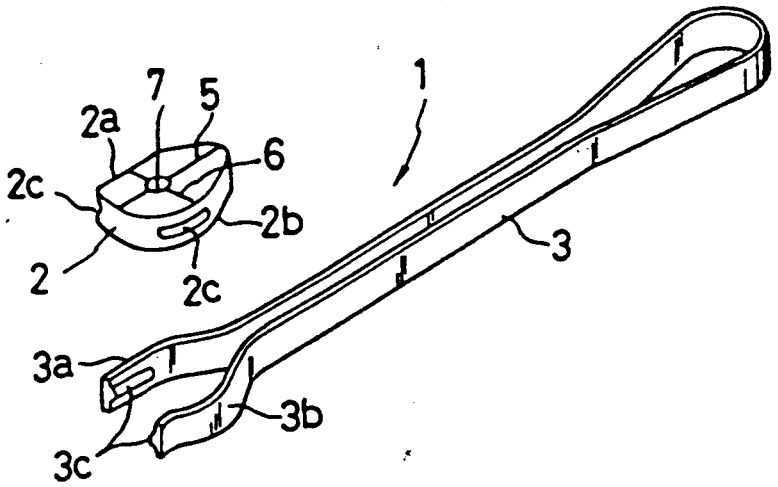
FIG. 5 (PRIOR ART)

As shown in FIG. 2, the conical portion 17*a* is dimensioned so as to mate with a tapered portion 14*a* of a sewing machine needle 14. The cylindrical portion 17*b* is adapted to fit over cylindrical shank 14*b* of the needle 14.

The ledge 17*c* is designed to fit into a thread guide 14*c* of the needle 14.

The operation of the mounting device as above arranged will now be described.

For mounting the needle 14 to a needle bar 8, the needle 14 is held with the pointed end (not shown) down. The needle is dropped into the through hole, as indicated by an arrow X in FIG. 2. At the moment of dropping the needle 14, the needle 14 may be slightly rotated to align the thread guide 14*c* with the ledge 17*c* formed on the conical portion 17*a* of the hole 17 in the needle engaging portion 12. Thereby, the orientation of the needle 14 is ensured.

The needle 14 is then held in the needle channel 9 in the bar 8, and the needle shank is inserted thereinto, as shown by an arrow Y of FIG. 2. The needle may then be tightened within channel 9 by a turning needle set screw 10. After tightening the needle 14, the needle mounting device 11 may be moved downwardly to readily remove the needle from the through hole 17, thereby completing the needle mounting operation.

Figure 6:
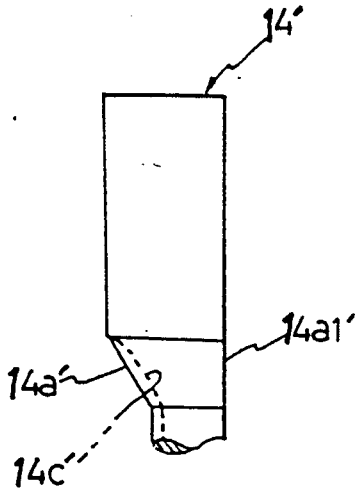
FIGS. 6*a* and 6*b* are sectional views illustrating a sewing machine needle mounting device according to another embodiment of the invention.
Figure 6:
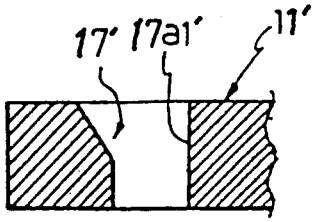

FIGS. 6*a* and 6*b* show a sewing machine needle mounting device according to another embodiment of the invention. Needles used in household sewing machines are often dimensioned to provide a flat surface 14*a*1′ and a tapered portion 14*a*′ as shown in FIG. 6*a*. To handle needles configured in such a manner, a needle mounting device 11′ is provided with a flat surface 17*a*1′ in the through hole 17′. This flat surface 17*a*1′ engages with the flat surface 14*a*1′ of the needle 14′, thereby setting and positioning the needle in the needle mounting device. Other than the differences in the configuration of the through hole 17′, the mounting device 11′ of FIG. 6*b* may be similar in overall configuration to the device 11 of FIGS. 1*a*–1*c* and 2. Mounting of the needle to the needle bar in home sewing machines can thereby be accomplished with the same ease that the device of FIGS. 1*a*–1*c* and 2 provides in commercial sewing machines.

Although the invention has been described by way of reference to the embodiments herein disclosed, it should be understood that the invention is not limited to the disclosed embodiments but should be interpreted only in accordance with the claims which follow.

What is claimed is:

1. A sewing machine needle mounting device having a needle engaging portion for releasably holding a sewing machine needle therein, and a grip portion for holding said device, wherein a hole is vertically provided through said engaging portion, said hole being partially formed as an inverted cone, and wherein a substantially vertical, protruding ledge is formed along a conical interior surface of said engaging portion, said ledge being dimensioned to fit in a grooved thread guide of said sewing machine needle.

2. A sewing machine needle mounting device having a gripping portion and needle engaging portion for releasably holding a sewing machine needle, said sewing machine needle having on an upper portion thereof a longitudinally extending flat surface, wherein a hole is vertically passed through said engaging portion, said hole being partially formed with an inverted hemicone so that an interior surface of said engaging portion has a flat surface and engages with said flat surface of said sewing machine needle.

* * * * *